US010955799B2

(12) United States Patent
Pittet

(10) Patent No.: US 10,955,799 B2
(45) Date of Patent: Mar. 23, 2021

(54) SETTING MECHANISM FOR TIMEPIECE MOVEMENT

(71) Applicant: Montres Breguet S.A., L'Abbaye (CH)

(72) Inventor: Jan Pittet, Le Sentier (CH)

(73) Assignee: Montres Breguet S.A., L'Abbaye (CH)

( * ) Notice: Subject to any disclaimer, the term of this patent is extended or adjusted under 35 U.S.C. 154(b) by 356 days.

(21) Appl. No.: 16/104,180

(22) Filed: Aug. 17, 2018

(65) Prior Publication Data

US 2019/0101867 A1 Apr. 4, 2019

(30) Foreign Application Priority Data

Sep. 29, 2017 (EP) ..... 17193963

(51) Int. Cl.
*G04B 27/04* (2006.01)
*G04B 27/02* (2006.01)

(52) U.S. Cl.
CPC ..... *G04B 27/045* (2013.01); *G04B 27/02* (2013.01); *G04B 27/04* (2013.01)

(58) Field of Classification Search
CPC ..... G04B 27/045; G04B 27/02; G04B 27/04; G04B 15/02; G04B 15/06; G04C 3/008;
(Continued)

(56) References Cited

U.S. PATENT DOCUMENTS 4,396,294 A 8/1983 Yoshida
7,604,395 B2 * 10/2009 Cabezas Jurin ..... G04B 19/23 368/124

(Continued)

FOREIGN PATENT DOCUMENTS

CH 237215 4/1945
CH 704 331 A1 7/2012

(Continued)

OTHER PUBLICATIONS

European Search Report dated Apr. 11, 2018 in European Application 17193963.0 filed Sep. 29, 2017 (with English Translation of Categories of Cited Documents).

*Primary Examiner* — Edwin A. Leon
(74) *Attorney, Agent, or Firm* — Oblon, McClelland, Maier & Neustadt, L.L.P.

(57) ABSTRACT

The invention relates to a setting mechanism for a timepiece movement, including a setting gear train, a winder rod adapted to be moved from a first axial position termed a running position to a second axial position termed a setting position, a sliding pinion adapted to be moved from a first axial position in which the sliding pinion is disengaged from the setting gear train to a second axial position in which the sliding pinion meshes with the setting gear train, and a lever interengaged with the sliding pinion and adapted to pivot, when the winding rod is moved from a running position to a setting position and vice versa, in order to move the sliding pinion from the first axial position to the second and vice versa. The setting mechanism further includes, according to the invention, a device for immobilizing the setting gear train. This immobilizing device includes first and second immobilizing arms and an immobilizing wheel interengaged with the setting gear train. The first and second immobilizing arms are adapted, on the one hand, to the interengaged with the immobilizing wheel in a configuration termed locked in which the setting gear train is immobilized and, on the other hand, to be disengaged from the immobilizing wheel in a configuration termed unlocked in which the sliding pinion is free from meshing with the setting gear train. The immobilizing device includes to this end a locking/unlocking lever interengaged with the sliding pinion and adapted to cooperate with the first and second immobilizing arms in order to pass from the locked configuration to the unlocked configu- (Continued)

ration and vice versa when the winding rod is moved from a running position to a setting position and vice versa.

10 Claims, 2 Drawing Sheets

(58) Field of Classification Search
CPC ..... G04C 9/00; G04G 13/02; G04G 5/027; G04G 9/0082; G04G 5/00; Y10T 74/19884; Y10T 74/1502; Y10T 74/18528
USPC ..... 368/192
See application file for complete search history.

(56) References Cited

U.S. PATENT DOCUMENTS

| | | | | |
|---|---|---|---|---|
| 7,607,822 | B2 * | 10/2009 | Cabezas Jurin | G04B 15/06 368/127 |
| 8,562,205 | B2 * | 10/2013 | Journe | G04B 15/08 368/131 |
| 9,052,694 | B2 * | 6/2015 | Tu | G04B 15/06 |
| 2004/0013046 | A1 | 1/2004 | Oechslin | |

FOREIGN PATENT DOCUMENTS

| | | | |
|---|---|---|---|
| EP | 1 367 462 | A1 | 12/2003 |
| GB | 2 071 364 | A | 9/1981 |
| JP | 49-062457 | U | 5/1974 |
| JP | 02-000683 | U | 1/1990 |
| WO | WO 2007/115984 | A2 | 10/2007 |

* cited by examiner

SETTING MECHANISM FOR TIMEPIECE MOVEMENT

FIELD OF THE INVENTION

This application claims priority from European Patent Application No. 17193963.0 filed on Sep. 29, 2017; the entire disclosure of which is incorporated herein by reference The present invention concerns a setting mechanism for a timepiece movement of a watch including a device for immobilizing the setting gear train in order to prevent movement of the hands in the event of shocks.

BACKGROUND OF THE INVENTION

When setting the time, the hands must be able to turn easily, because of the action of the winding rod, but must also be driven securely when the watch is running. A friction system is generally provided for this purpose in order to guarantee easy adjustment of the time whilst ensuring reliable driving of the hands by the finishing gear train when the watch is running.

One well-known friction system is indenting, which consists in adjusting the cannon-pinion on the rod of the centre pinion to obtain "coarse rubbing" to enable setting without driving the finishing gear train. To this end, the thickness of the cannon-pinion is reduced in the middle and it is pinched by means of a tool dedicated to this purpose so as to form a projection that presses against a conical cut in the rod of the centre pinion.

However, indenting is a dedicate operation that demands rigorous control to be sure that the value of the torque generated by the friction between the cannon-pinion and the rod of the centre pinion is the optimum value. Actually, too low a friction torque can, in the event of shocks, lead to movement of the hands due to their out of balance. Moreover, too high a torque can cause deterioration of the setting gear train (sliding pinion/setting wheels/timer) or of the finishing gear train (centre/mean/second/escapement) during setting.

SUMMARY OF THE INVENTION

Consequently, an object of the present invention is to provide a setting mechanism in order in particular to alleviate the aforementioned disadvantages of the prior art and to prevent any drift of the time display if the watch is subjected to high shocks.

To this end, the setting mechanism for a timepiece movement includes:

a setting gear train, a winder rod adapted to be moved from a first axial position termed a running position to a second axial position termed a setting position, a sliding pinion adapted to be moved from a first axial position in which the sliding pinion is disengaged from the setting gear train to a second axial position in which the sliding pinion meshes with the setting gear train, and a lever interengaged with the sliding pinion and adapted to pivot, when the winding rod is moved from a running position to a setting position and vice versa, in order to move the sliding pinion from the first axial position to the second and vice versa.

The setting mechanism according to the invention further includes a device for immobilizing the setting gear train. This immobilizing device includes first and second immobilizing arms and an immobilizing wheel interengaged with the setting gear train. The first and second immobilizing arms are adapted, on the one hand, to the interengaged with the immobilizing wheel in a configuration termed locked in which the setting gear train is immobilized and, on the other hand, to be disengaged from the immobilizing wheel in a configuration termed unlocked in which the sliding pinion is free from meshing with the setting gear train. The immobilizing device includes to this end a locking/unlocking lever interengaged with the sliding pinion and adapted to cooperate with the first and second immobilizing arms in order to pass from the locked configuration to the unlocked configuration and vice versa when the winding rod is moved from a running position to a setting position and vice versa.

According to one advantageous embodiment, the immobilizing wheel includes teeth in which the tip of each tooth has a curved profile. The first and second immobilizing arms each include a portion having a curved edge provided with microteeth. The radius of curvature of the curved edge essentially corresponds to the radius of the tip circle of the immobilizing wheel. These microteeth are intended to come into contact with the teeth of the immobilizing wheel in the locked configuration of the immobilizing device. The particular profile of the teeth of the immobilizing wheel and of the microteeth has the advantage of allowing an angular precision of immobilization of the wheel so that the deviation of the hands is negligible after correction of the time when the winding rod is returned to the running position.

According to one advantageous embodiment, the microteeth of the first and second immobilizing arms are symmetrical to one another so as to prevent rotation of the immobilizing wheel in either direction.

According to one advantageous embodiment, the first and second immobilizing arms are superposed and mounted to pivot relative to one another about a common axis. The curved edge of the lower immobilizing arm, respectively the upper immobilizing arm, is intended to come into contact with a lower portion, respectively an upper portion, of the teeth of the immobilizing wheel. According to another variant embodiment, one or both immobilizing arms may have an additional thickness in the part including the microteeth adapted in such a manner that the two arms bear on the immobilizing wheel at the same height.

According to one advantageous embodiment, the locking/unlocking lever is adapted to pivot about a pivot when the winding rod is moved from a running position to a setting position and vice versa. This locking/unlocking lever includes two arms extending on either side of the pivot. One end of one of the two arms is interengaged with the sliding pinion whilst the other of the two arms includes a distal portion intended to cooperate with the upper immobilizing arm and a proximal portion intended to cooperate with the lower immobilizing arm.

According to one advantageous embodiment, the distal portion bears against a rectilinear flank of the upper immobilizing arm. For its part, the proximal portion bears against or is intended to come to bear against an actuating element, preferably a pin, of the lower immobilizing arm in order to disengage the immobilizing arm from the teeth of the immobilizing wheel when the locking/unlocking lever is pivoted by the axial movement of the sliding pinion.

According to one advantageous embodiment, the immobilizing wheel is the timer wheel of the setting gear train.

According to a variant embodiment, the immobilizing wheel is mounted on and fastened to the shaft of a standard timer wheel of the setting gear train.

BRIEF DESCRIPTION OF THE DRAWINGS

Other particular features and advantages will emerge clearly from the following description thereof, given by way of nonlimiting illustration, with reference to the appended drawings, in which.

DETAILED DESCRIPTION OF THE INVENTION

Figure 1:
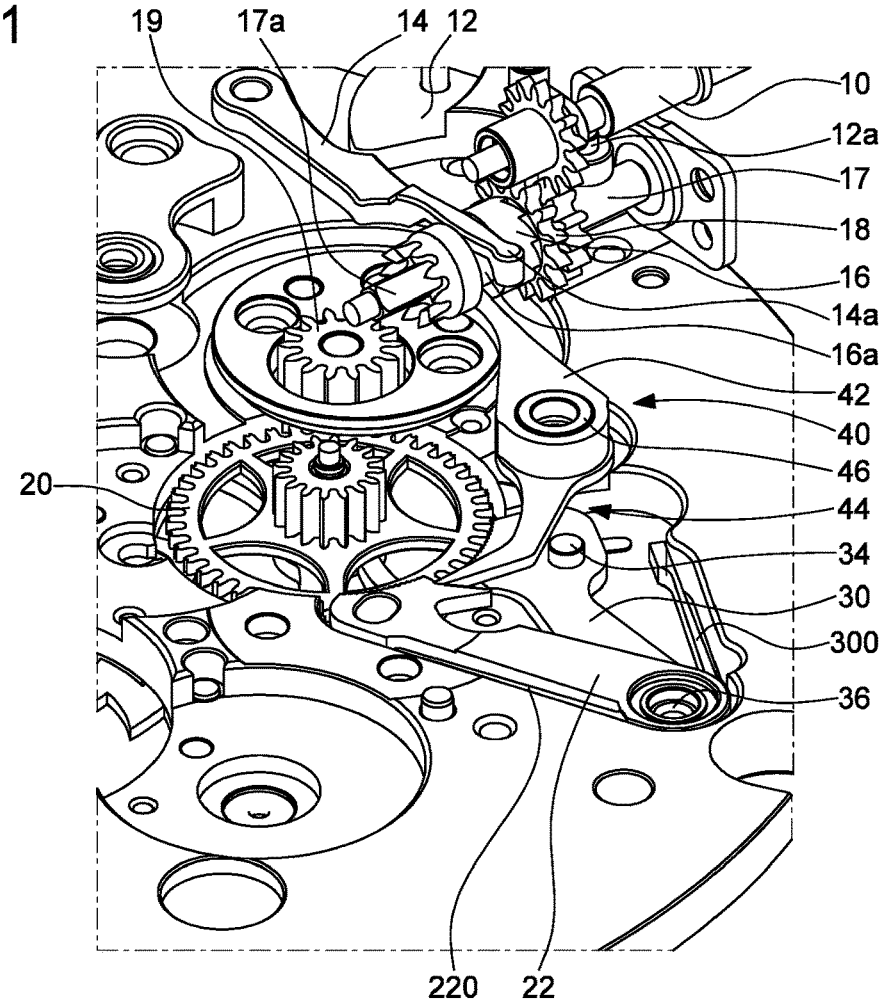
FIG. 1 is a perspective view of the setting mechanism in accordance with one advantageous embodiment of the invention when the immobilizing device is in a locked configuration.

Referring to FIG. 1, the setting mechanism includes, in the conventional manner, a pull-rod 12 comprising a tenon 12*a* housed in a recess of the winding rod 10, a lever 14 adapted to cooperate with the pull-rod 12, and a sliding piston 16. The latter is fitted onto a segment 17*a* of square cross section of a secondary rod 17 in such a manner as to be able to be moved along that segment 17*a* from a first axial position, in which the sliding pinion 16 is interengaged with a winding pinion 18, to a second axial position, in which the sliding pinion 16 is interengaged with a setting wheel 19 of the setting gear train as shown in FIG. 2*b*.

The lever 14 includes an end 14*a* arranged in a circular groove 16*a* of the sliding pinion 16. When the winding rod 10 is pulled out to position it in the axial position corresponding to the setting position, the pull-rod 12 pivots and pushes on the lever 14, which causes the sliding pinion 16 to slide along the segment 17*a* of the secondary rod 17. The sliding pinion 16 is therefore disengaged from the pinion of the winder 18 and comes to mesh with the setting wheel 19 of the setting gear train to drive the hands.

Figure 3:
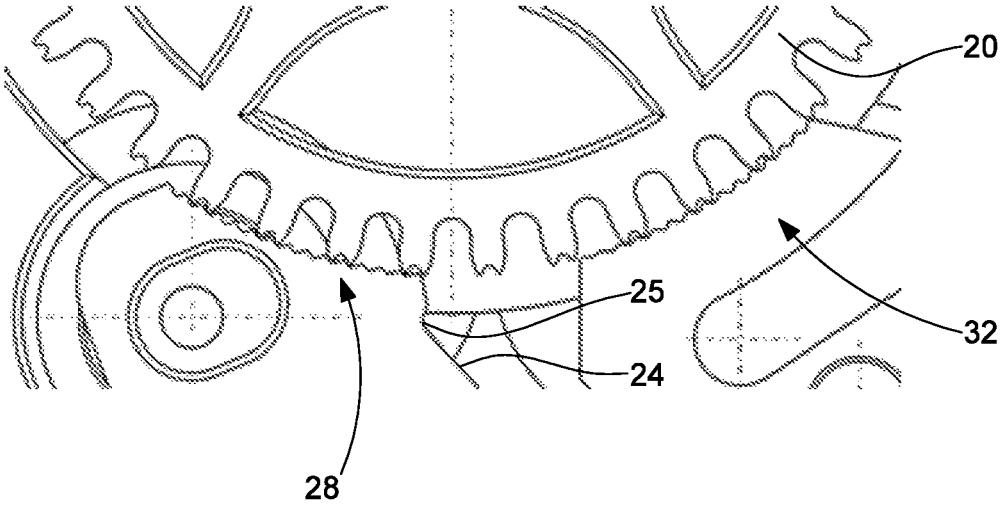
FIG. 3 is a detailed view of the immobilizing arms interengaged with the immobilizing wheel from FIG. 2*a*.

The setting mechanism according to the invention further includes a device for immobilizing the setting gear train. That device includes an immobilizing wheel 20 configured to cooperate on the one hand with the setting gear train and on the other hand with first and second immobilizing arms 22, 30. Referring to FIG. 3 in particular, the immobilizing wheel 20 includes teeth and the tip of each tooth has a curved profile. This particular profile of the teeth of the immobilizing wheel 20 enables, on the one hand, retention of teeth enabling meshing with the sliding pinion 16 via the setting wheels for setting the time, in order to fulfil the function of a standard timer wheel, and, on the other hand, to increase the angular precision of immobilization by the first and second immobilizing arms 22, 30. To this end, as shown in FIG. 3, the latter each include a portion 28, 32 including a curved edge extending along a circular arc over an angle preferably between 30° and 40° inclusive, the radius of curvature of which essentially corresponds to the radius of the tip circle of the immobilizing wheel 20. The curved edges of the immobilizing arms 22, 30 are provided with microteeth in order to increase the points of contact with the teeth of the immobilizing wheel 20 when the curved edges are in contact with the latter. This has the advantage of increasing the angular precision of immobilization.

The first and second immobilizing arms 22, 30 are moreover superposed and mounted to pivot relative to one another about a tenon 36. The microteeth of the upper immobilizing arm 22 and of the lower immobilizing arm 30 are held against an upper portion, respectively a lower portion, of the teeth of the immobilizing wheel 20 by a spring (220 and 300) when the immobilizing device is in a locked configuration. These two sets of microteeth are symmetrical with respect to an axis passing through the centre of the immobilizing wheel 20 and through the pivot axis of the two immobilizing arms 22, 30. The two sets of microteeth are therefore oriented in opposite directions.

There is therefore a bracing effect between the teeth of the immobilizing wheel 20 and the microteeth of the first, respectively the second immobilizing arm 22 when the wheel tends to want to pivot respectively in the clockwise direction and the anticlockwise direction. The two immobilizing arms 22, 30 are therefore necessary to prevent any rotation of the immobilizing wheel in either direction. This enables immobilization of the setting wheel to be guaranteed in the event of high shocks on the watch which a conventional friction system is not able to withstand. It should be noted that, in contrast to conventional setting mechanisms, the cannon-pinion has the advantage that it can simply be adjusted on the cannon of the minutes wheel with no "coarse rubbing", which enables alleviation of the problems of wear of the setting gear train or the risks of damaging the finishing gear train when the "coarse rubbing" is not the optimum.

Figure 2A:
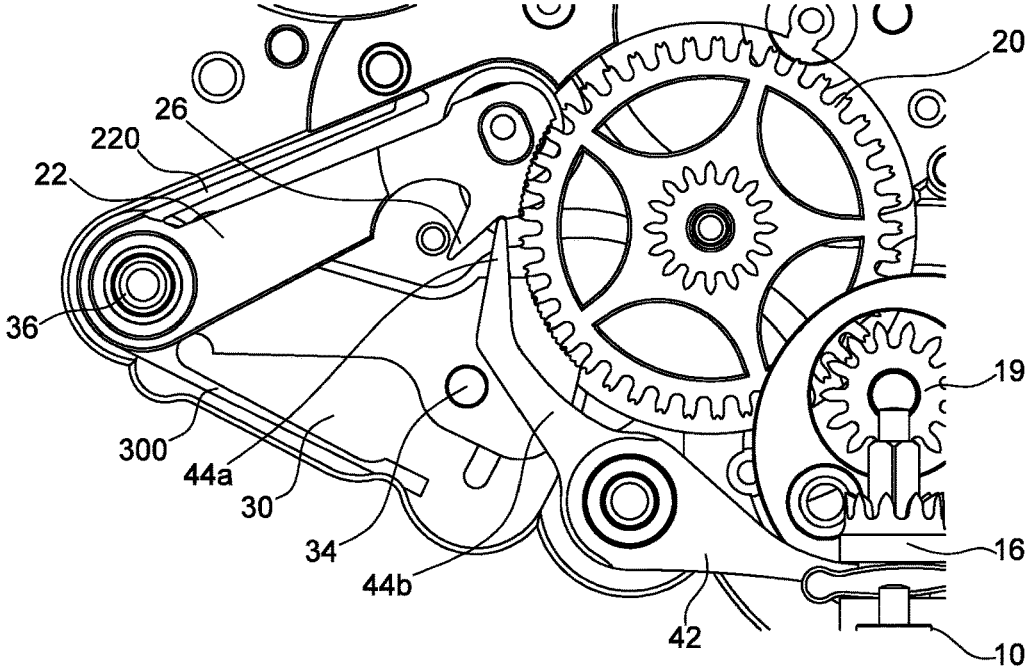
FIG. 2*a* is a top view of FIG. 1.
Figure 2B:
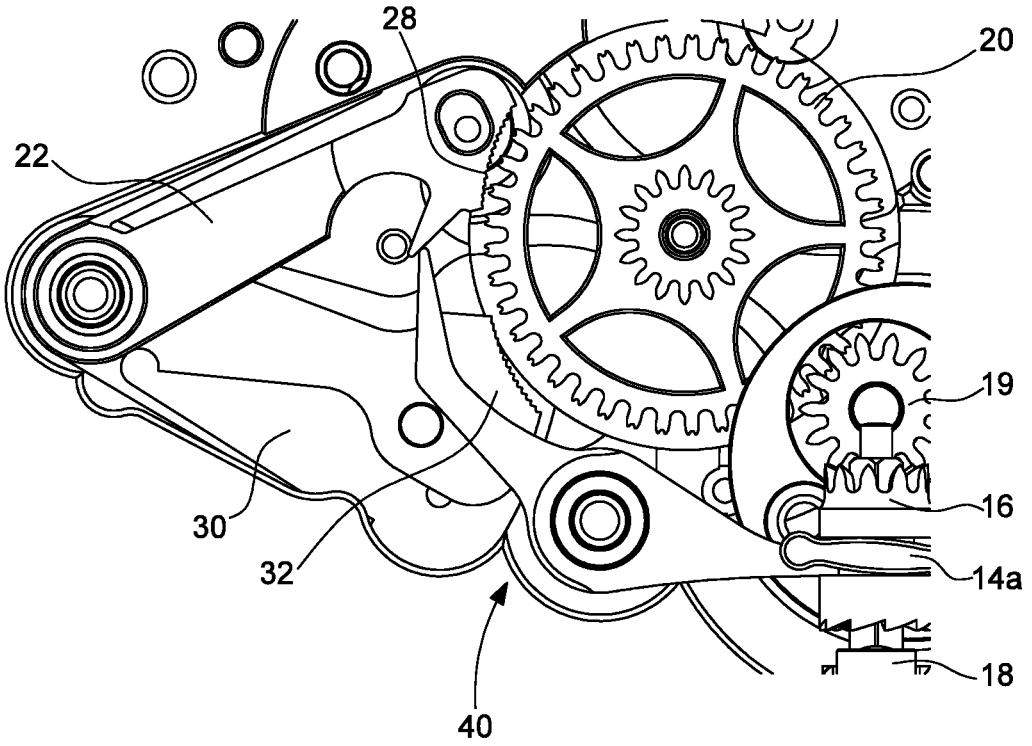
FIG. 2*b* is a top view of the setting mechanism when the immobilizing device is in an unlocked configuration.

Referring to FIGS. 2*a* and 3, the first immobilizing arm 22 includes a nose 26 provided with a rectilinear flank 24 extending from the point of the nose 26 to a corner 25 forming an obtuse angle. For its part, the second immobilizing arm 30 includes a pin 34 extending vertically relative to the plane in which the second arm is adapted to pivot.

The device for immobilizing the setting gear train further includes a locking/unlocking lever 40 intended to lock and to unlock the immobilizing wheel 20. To this end, this locking/unlocking lever 40 is adapted to pivot about a tenon 46 and includes two arms 42, 44 extending on either side of the tenon 46. One end of one of the two arms 42 is housed in the circular groove 16*a* of the sliding pinion 16 facing the end 14*a* of the lever 14. In other words, the end of the arm 42 of the locking/unlocking lever 40 and the end 14*a* of the lever 14 are arranged on either side of a rod connecting the part of the sliding pinion 16 intended to mesh with the setting wheel 19 and the part of the sliding pinion 16 intended to mesh with the winding pinion 18.

The other of the two arms 44 of the locking/unlocking lever 40 resembles a cranked arm including a distal portion 44*a* and a proximal portion 44*b* (FIG. 2*a*). The distal portion 44*a* includes a pointed end housed in the corner 45 of the first immobilizing arm 22 when the setting gear train immobilizing device is in a locked configuration. The proximal portion 44*b* is intended to come to abut against the pin 34 of the second immobilizing arm 30 when the winding rod 10 is moved into a setting position.

In FIG. 2*a* the setting gear train immobilizing device is in a locked configuration, that is to say that the immobilizing wheel 20 is locked by the first and second immobilizing arms 22, 30, thereby guaranteeing immobilization of the setting gear train if high shocks are exerted on the watch during normal operation of the watch.

When it is necessary to set the time, the winding rod 10 is moved from a first axial position corresponding to a running position of the watch to a second axial position corresponding to a setting position of the watch. The axial movement of the winding rod 10 actuates rotation of the pull-rod 12, which in turn actuates the lever 14 so that its end 14*a* moves the sliding pinion 16 along the segment 17*a* of the secondary rod 17 from a first axial position, in which it is interengaged with the winding pinion 18, to a second axial position, in which it is interengaged with the setting wheel 19 of the setting gear train.

During this sequence, the arms 42, 44 of the locking/unlocking lever 40 pivot about the tenon 46 in the anticlockwise direction because of the action of the sliding pinion 16 on the end of the arm 42 when it is moved from its first axial position to its second axial position. During this sequence, the pointed end of the distal portion 44*a* of the arm 44 exerts a force on the rectilinear flank 24 of the first immobilizing arm 22, as it moves along that flank 24, in order for the first arm 22 to pivot about the tenon 36 in such a manner as to disengage the first microteeth from the immobilizing wheel 20. Simultaneously, the proximal portion 44*b* comes to bear against the pin 34 of the second immobilizing arm 30 in order to disengage the second microteeth from the immobilizing wheel 20.

The immobilizing device is shown in FIG. 2*b* in an unlocked configuration and setting the time can advantageously be effected with no risk of damaging the finishing gear train since, as mentioned above, the cannon-pinion is simply adjusted on the cannon of the minutes wheel with no "coarse rubbing".

Once the time has been set, the winding rod 10 is moved into the first axial position, and the locking/unlocking lever 40 pivots about its tenon 46 in the clockwise direction, which returns the arm 44 to the position shown in FIG. 2*a*. At the same time, the first and second immobilizing arms 22, 30 are pivoted about the tenon 36 by their respective return spring in order to return their respective microteeth to a position against the teeth of the immobilizing wheel 20 and to retain them there, thus locking the immobilizing device so that the watch is insensitive to high shocks.

Naturally, the invention is not limited to the embodiment that has just been described with reference to the figures and variants could be envisaged without departing from the scope of the invention. For example, the immobilizing wheel 20 could fulfil only the function of immobilizing the setting gear train without fulfilling the function of the timer wheel. An immobilizing wheel could therefore be mounted on and fastened to the shaft of a standard timer wheel and immobilized by the two immobilizing arms. The teeth of the immobilizing wheel would then be dedicated only to cooperating with the teeth of the immobilizing arms and the number of teeth could be increased to improve the angular precision of immobilization. Moreover, according to the embodiment described, the sliding pinion is adjusted to be moved over a segment of a secondary rod off-axis relative to the winding rod. Now, this structure is dictated by the constraints of a particular timepiece movement. There could therefore be a setting mechanism according to the invention in which the segment 17*a* is an integral part of the winding rod.

What is claimed is:

1. A setting mechanism for a timepiece movement, including:

a setting gear train, a winder rod adapted to be moved from a first axial position termed a running position to a second axial position termed a setting position, a sliding pinion adapted to be moved from a first axial position in which the sliding pinion is disengaged from the setting gear train to a second axial position in which the sliding pinion meshes with the setting gear train, a lever interengaged with the sliding pinion and adapted to pivot, when the winding rod is moved from a running position to a setting position and vice versa, in order to move the sliding pinion from the first axial position to the second and vice versa, and a device for immobilizing the setting gear train, wherein the immobilizing device includes first and second immobilizing arms and an immobilizing wheel interengaged with the setting gear train, the first and second immobilizing arms being adapted to the interengaged with the immobilizing wheel in a configuration termed locked in which the setting gear train is immobilized and to be disengaged from the immobilizing wheel in a configuration termed unlocked in which the sliding pinion is free from meshing with the setting gear train, the immobilizing device including to this end a locking/unlocking lever interengaged with the sliding pinion and adapted to cooperate with the first and second immobilizing arms in order to pass from the locked configuration to the unlocked configuration and vice versa when the winding rod is moved from a running position to a setting position and vice versa.

2. The mechanism according to claim 1, wherein the immobilizing wheel includes teeth in which a tip of each tooth has a curved profile and wherein the first and second immobilizing arms each include a portion having a curved edge provided with microteeth, a radius of curvature of the curved edge essentially corresponding to the radius of the tip circle of the immobilizing wheel.

3. The mechanism according to claim 2, wherein the microteeth of the first and second immobilizing arms are arranged against the teeth of the immobilizing wheel in the locked configuration and are symmetrical to one another so as to prevent rotation of the immobilizing wheel in either direction.

4. The mechanism according to claim 1, wherein the first and second immobilizing arms are superposed and mounted to pivot relative to one another about a common axis, the curved edge of the lower immobilizing arm, respectively the upper immobilizing arm, being intended to come into contact with a lower portion, respectively an upper portion, of the teeth of the immobilizing wheel.

5. The mechanism according to claim 1, wherein the locking/unlocking lever is adapted to pivot about a pivot when the winding rod is moved from a running position to a setting position and vice versa, and includes two arms extending on either side of the pivot, one end of one of the two arms being interengaged with the sliding pinion whilst the other of the two arms includes a distal portion intended to cooperate with the upper immobilizing arm and a proximal portion intended to cooperate with the lower immobilizing arm.

6. The mechanism according to claim 5, wherein the distal portion bears against a rectilinear flank of the upper immobilizing arm and wherein the proximal portion bears against or is intended to come to bear against an actuating element of the lower immobilizing arm in order to disengage the immobilizing arm from the teeth of the immobilizing wheel when the locking/unlocking lever is pivoted by the axial movement of the sliding pinion.

7. The mechanism according to claim 1, wherein the immobilizing wheel is the time at wheel of the setting gear train.

8. The mechanism according to claim 1, wherein the immobilizing wheel is mounted on and fastened to the shaft of a standard timer wheel of the setting gear train.

9. A timepiece movement including the mechanism according to claim 1.

10. The timepiece including the timepiece movement according to claim 9.

* * * * *